US009500968B2

(12) United States Patent
McGuire et al.

(10) Patent No.: US 9,500,968 B2
(45) Date of Patent: Nov. 22, 2016

(54) ADDITION OF NON-NETWORKED HOLE TRANSPORT MOLECULE TO FLUORINATED STRUCTURED ORGANIC FILM FOR IMPROVED CORONA RESISTANCE

(71) Applicant: XEROX CORPORATION, Norwalk, CT (US)

(72) Inventors: Gregory McGuire, Oakville (CA); Richard A. Klenkler, San Jose, CA (US); Adrien P. Côté, Clarkson (CA); Yvan Gagnon, Mississauga (CA)

(73) Assignee: XEROX CORPORATION, Norwalk, CT (US)

( * ) Notice: Subject to any disclaimer, the term of this patent is extended or adjusted under 35 U.S.C. 154(b) by 1 day.

(21) Appl. No.: 14/620,053

(22) Filed: Feb. 11, 2015

(65) Prior Publication Data

US 2016/0231660 A1 Aug. 11, 2016

(51) Int. Cl.
*G03G 5/147* (2006.01)
*G03G 7/00* (2006.01)

(52) U.S. Cl.
CPC ..... *G03G 5/14769* (2013.01); *G03G 5/14791* (2013.01); *G03G 5/14795* (2013.01); *G03G 7/002* (2013.01)

(58) Field of Classification Search
CPC ..... G03G 5/14795; G03G 5/14791; G03G 5/14769
USPC ..... 430/66, 58.7
See application file for complete search history.

(56) References Cited

U.S. PATENT DOCUMENTS

| | | | | |
|---|---|---|---|---|
| 2,559,752 | A | 7/1951 | Berry | |
| 7,666,927 | B2 | 2/2010 | Combes et al. | |
| 7,979,003 | B2 * | 7/2011 | Aoshima | G03G 21/08 399/115 |
| 8,080,351 | B2 * | 12/2011 | Heuft | C07C 213/08 430/132 |
| 8,247,142 | B1 * | 8/2012 | Cote | C08G 65/007 427/372.2 |
| 8,372,566 | B1 | 2/2013 | Cote et al. | |
| 2010/0227157 | A1 * | 9/2010 | Heuft | B82Y 10/00 428/332 |
| 2012/0028176 | A1 * | 2/2012 | Cote | G03G 5/0589 430/56 |

* cited by examiner

*Primary Examiner* — Christopher Rodee
(74) *Attorney, Agent, or Firm* — Pillsbury Winthrop Shaw Pittman LLP

(57) ABSTRACT

An overcoat layer comprises a structured organic film (SOF) comprising a plurality of segments and a plurality of linkers including a first fluorinated segment and a second electro-active segment, and an antioxidant is present in the SOF; and a hole transport molecule which does not form a network with the SOF.

17 Claims, 2 Drawing Sheets

ADDITION OF NON-NETWORKED HOLE TRANSPORT MOLECULE TO FLUORINATED STRUCTURED ORGANIC FILM FOR IMPROVED CORONA RESISTANCE

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Although excellent toner images may be obtained with multilayered belt or drum photoreceptors, it has been found that as more advanced, higher speed electrophotographic copiers, duplicators, and printers are developed, there is a greater demand on print quality. The delicate balance in charging image and bias potentials, and characteristics of the toner and/or developer, must be maintained. This places additional constraints on the quality of photoreceptor manufacturing, and thus on the manufacturing yield.

Imaging members are generally exposed to repetitive electrophotographic cycling, which subjects the exposed charged transport layer or alternative top layer thereof to mechanical abrasion, chemical attack and heat. This repetitive cycling leads to gradual deterioration in the mechanical and electrical characteristics of the exposed charge transport layer. Physical and mechanical damage during prolonged use, especially the formation of surface scratch defects, is among the chief reasons for the failure of belt photoreceptors. Therefore, it is desirable to improve the mechanical robustness of photoreceptors, and particularly, to increase their scratch resistance, thereby prolonging their service life. Additionally, it is desirable to increase resistance to light shock so that image ghosting, background shading, and the like is minimized in prints.

Providing a protective or wear-resistant overcoat layer is a conventional means of extending the useful life of photoreceptors.

However, in scorotron xerography, the low wear overcoats are associated with poor Lateral Charge Migration (LCM) that is due to the aggressive scorotron generated corona. A second problem is the decrease in discharge rate associated with applying a cross-linked overcoat layer on top of a traditional charge transport layer. The problem of discharge rate reduction when applying low wear cross-linked overcoat layers was due to a reduction in average charge mobility throughout the photosensitive layers. This problem was overcome by using a structured organic film (SOF) design which provides a robust surface that is low wear and scratch resistant. SOF compositions have been described in U.S. Pat. No. 8,372,566, which is incorporated by reference herein in its entirety. Such SOF compositions are chemically and mechanically robust materials that demonstrate many superior properties to conventional photoreceptor materials and increase the photoreceptor life by preventing chemical degradation pathways caused by the xerographic process.

However, the poor LCM problem remained with the SOF design and the devices remain unusable in scorotron xerography. Therefore, there exists a need to further increase the LCM performance of the SOF design to enable usage in scorotron xerography for long term printing.

SUMMARY

According to embodiments illustrated herein, there is provided an overcoat layer comprises a structured organic film (SOF) comprising a plurality of segments and a plurality of linkers including a first fluorinated segment and a second electroactive segment; an antioxidant which does not form a network with the SOF; and a hole transport molecule which does not form a network with the SOF.

Certain embodiments provide an imaging member comprising a substrate; a charge generating layer; a charge transport layer; and an overcoat layer comprises a structured organic film (SOF) comprising a plurality of segments and a plurality of linkers including a first fluorinated segment and a second electroactive segment; and an antioxidant which does not form a network with the SOF; and a hole transport molecule which does not form a network with the SOF.

Certain embodiments provides a xerographic apparatus comprising an imaging member comprising a plurality of layers, wherein an overcoat layer of the imaging layer is an imaging surface that comprises a structured organic film (SOP) comprising a plurality of segments and a plurality of linkers including a first fluorinated segment and a second electroactive segment; and an antioxidant is present in the SOF; and a hole transport molecule which does not form a network with the SOF; a charging unit to impart an electrostatic charge on the imaging member; an exposure unit to create an electrostatic latent image on the imaging member; an image material delivery unit to create an image on the imaging member; a transfer unit to transfer the image from the imaging member; and an optional cleaning unit.

DETAILED DESCRIPTION

Figure 1:
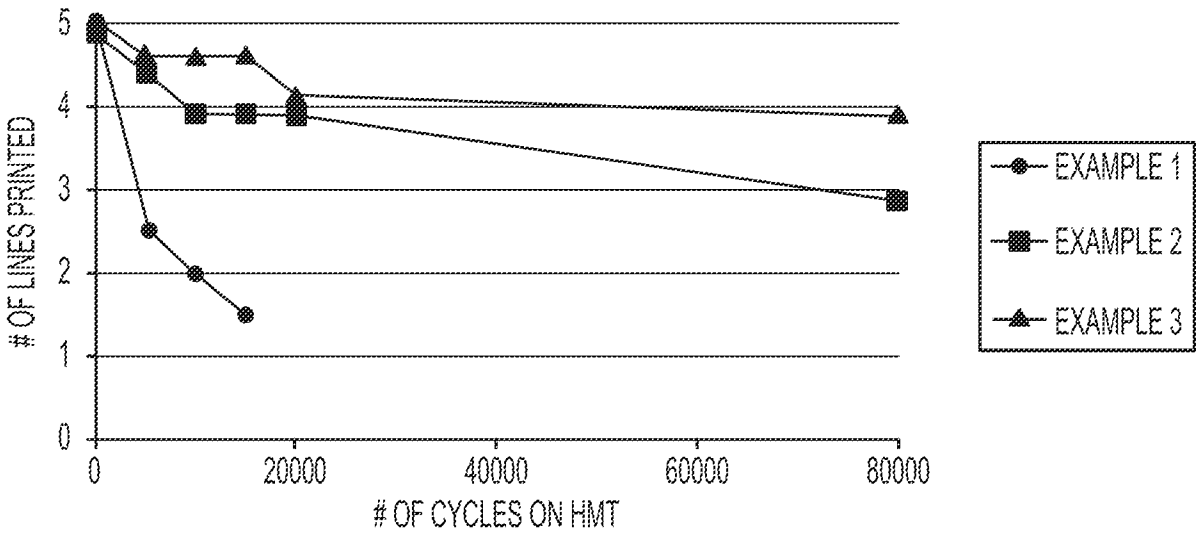
FIG. 1 illustrates a graph of photoconductor printed lines versus HMT cycles where HMT refers to a known high speed Hyper Mode Test fixture used to perform accelerated corona exposure from a scorotron device to a target photoreceptor. The exposure is proportional to the number of HMT cycles.

In the following description, it is understood that other embodiments may be used and structural and operational changes may be made without departing from the scope of the present disclosure.

In this specification and the claims that follow, singular forms such as "a," "an," and "the" include plural forms unless the content clearly dictates otherwise.

As used herein, the terms "optional" or "optionally" means that the subsequently described event or circumstance can or cannot occur, and that the description includes instances where said event or circumstance occurs and instances where it does not.

"Structured organic film" (SOF) refers to a COF that is a film at a macroscopic level. The imaging members of the present disclosure may comprise composite SOFs, which optionally may have a capping unit or group added into the SOF The term "SOF" or "SOF composition" generally refers to a covalent organic framework (COF) that is a film at a macroscopic level. However, as used in the present disclosure the term "SOF" does not encompass graphite, graphene, and/or diamond. The phrase "macroscopic level" refers, for example, to the naked eye view of the present SOFs. Although COFs are a network at the "microscopic level" or "molecular level" (requiring use of powerful magnifying equipment or as assessed using scattering methods), the present SOF is fundamentally different at the "macroscopic level" because the film is for instance orders of magnitude larger in coverage than a microscopic level COF network. SOFs described herein that may be used in the embodiments described herein are solvent resistant and have macroscopic morphologies much different than typical COFs previously synthesized.

The term "fluorinated SOF" refers, for example, to a SOF that contains fluorine atoms covalently bonded to one or more segment types or linker types of the SOF. The fluorinated SOFs of the present disclosure may further comprise fluorinated molecules that are not covalently bound to the framework of the SOF, but are randomly distributed in the fluorinated SOF composition (i.e., a composite fluorinated SOF). However, an SOF, which does not contain fluorine atoms covalently bonded to one or more segment types or linker types of the SOF, that merely includes fluorinated molecules that are not covalently bonded to one or more segments or linkers of the SOF is a composite SOF, not a fluorinated SOF.

The present disclosure provides an overcoat layer comprising (1) a structured organic film (SOF), and (2) a hole transport molecule and an anti-oxidant, wherein the SOF includes a plurality of segments and a plurality of linkers including a first fluorinated segment and a second electroactive segment, and further wherein the hole transport molecule is present freely in the overcoat layer without forming any network with the SOF. The anti-oxidant also does not form a network with the SOF. By not forming any network with the SOF, means that the hole transport molecule are not covalently linked to the network structure of the SOF. Firstly, when present freely it is thought that the hole transport molecule acts to reduce the passivity of the overcoat layer to corona effluents. Secondly, the particular hole transport molecule of the present embodiments is thought to have an inherent resistance to attack from corona effluents and thus resistance to LCM. Thirdly, the hole transport properties of the hole transport molecule enable addition to the overcoat without reducing electrical performance.

A hole transport molecule can be added to the networked structure of the SOF (or, in embodiments, fluorinated SOF) in an amount from about 0.1% to about 20%, from about 1% to about 15%, from about 5% to about 14%, from about 8% to about 12%, by weight based on the total weight of the overcoat layer, or in embodiments, based on the total weight of outermost layer. The hole transport molecule is incorporated to the SOF and present freely in the overcoat layer without forming any network with the SOF. The hole transport molecule may be included in the overcoat layer by mixing the hole transport molecule with the SOF. This is accomplished by dissolution of the hole transport molecule into the SOF solution before or after heating of the SOF solution.

The hole transport molecule may be an arylamine compound, such as a di- or tri-arylamine. The term "arylamine" refers, for example, to moieties containing both aryl and amine groups. Exemplary aralkylene groups have the structure Ar—NRR', in which Ar represents an aryl group and R and R' are groups that may be independently selected from hydrogen and substituted and unsubstituted alkyl, alkenyl, aryl, and other suitable functional groups. The term "triarylamine" refers, for example, to arylamine compounds having the general structure NArAr'Ar", in which Ar, Ar' and Ar" represent independently selected aryl groups. "Amine" refers, for example, to an alkyl moiety in which one or more of the hydrogen atoms has been replaced by an —NH2 group. The term "lower amine" refers, for example, to an alkyl group of about 1 to about 6 carbon atoms in which at least one, and optionally all, of the hydrogen atoms has been replaced by an —$NH_2$ group. The term "aryl" refers, for example, to monocyclic or fused-ring polycyclic (i.e., rings which share adjacent pairs of carbon atoms) carbocyclic aromatic ring systems having about 6 to about 20 carbon atoms or more, such as phenyl, naphthyl, anthrycyl, and the like. Optionally, these groups may be substituted with one or more independently selected substituents, including alkyl, alkenyl, alkoxy, hydroxyl, nitro and further aryl groups.

Exemplary hole transport molecule include, but is not limited to, bis [4-(methoxymethyl) phenyl] phenylamine (AE139, available from Fujifilm Fine Chemicals.

An antioxidant can be added to the networked structure of the SOF (or, in embodiments, fluorinated SOF) in an amount from about 0.25% to about 10%, from about 0.5% to about 5%, from about 1% to about 3%, by weight based on the total weight of the overcoat layer, or in embodiments, based on the total weight of outermost layer. Similar to the hole transport molecule, the antioxidant is incorporated to the SOF and present freely in the overcoat layer without forming any network with the SOF. The anti-oxidant is incorporated into the SOF by addition into the SOF solution before or after heating of the SOF solution. Antioxidants are included in the networked structure of the SOF to protect the SOF from oxidation.

Exemplary antioxidants include, but are not limited to, (1) N,N'-hexamethylene bis(3,5-di-tert-butyl-4-hydroxy hydrocinnamamide) (IRGANOX 1098, available from Ciba-Geigy Corporation), (2) 2,2-bis(4-(2-(3,5-di-tert-butyl-4-hydroxyhydrocinnamoyloxy))ethoxyphenyl) propane (TOPANOL-205, available from ICI America Corporation), (3) tris(4-tert-butyl-3-hydroxy-2,6-dimethyl benzyl) isocyanurate (CYANOX 1790, 41, 322-4, LTDP, Aldrich D12, 840-6), (4) 2,2'-ethylidene bis(4,6-di-tert-butylphenyl) fluoro phosphonite (ETHANOX-398, available from Ethyl Corporation), (5) tetrakis(2,4-di-tert-butylphenyl)-4,4'-biphenyl diphosphonite (ALDRICH 46, 852-5; hardness value 90), (6) pentaerythritol tetrastearate (TCI America #PO739), (7) tributylammonium hypophosphite (Aldrich 42, 009-3), (8) 2,6-di-tert-butyl-4-methoxyphenol (Aldrich 25, 106-2), (9) 2,4-di-tert-butyl-6-(4-methoxybenzyl)phenol (Aldrich 23, 008-1), (10) 4-bromo-2,6-dimethylphenol (Aldrich 34, 951-8), (11) 4-bromo-3,5-didimethylphenol (Aldrich B6, 420-2), (12) 4-bromo-2-nitrophenol (Aldrich 30, 987-7), (13) 4-(diethyl aminomethyl)-2,5-dimethylphenol (Aldrich 14, 668-4), (14) 3-dimethylaminophenol (Aldrich D14, 400-2), (15) 2-amino-4-tert-amylphenol (Aldrich 41, 258-9), (16) 2,6-bis(hydroxymethyl)-p-cresol (Aldrich 22, 752-8), (17) 2,2'-methylenediphenol (Aldrich B4, 680-8), (18) 5-(diethylamino)-2-nitrosophenol (Aldrich 26, 951-4), (19) 2,6-dichloro-4-fluorophenol (Aldrich 28, 435-1), (20) 2,6-dibromo fluoro phenol (Aldrich 26, 003-7), (21) a trifluoro-o-cresol (Aldrich 21, 979-7), (22) 2-bromo-4-fluorophenol (Aldrich 30, 246-5), (23) 4-fluorophenol (Aldrich F1, 320-7), (24) 4-chlorophenyl-2-chloro-1,1,2-tri-fluoroethyl sulfone (Aldrich 13, 823-1), (25) 3,4-difluoro phenylacetic acid (Aldrich 29, 043-2), (26) 3-fluorophenylacetic acid (Aldrich 24, 804-5), (27) 3,5-difluoro phenylacetic acid (Aldrich 29, 044-0), (28) 2-fluorophenylacetic acid (Aldrich 20, 894-9), (29) 2,5-bis(trifluoromethyl)benzoic acid (Aldrich 32, 527-9), (30) ethyl-2-(4-(4-(trifluoromethyl)phenoxy)phenoxy) propionate (Aldrich 25, 074-0), (31) tetrakis(2,4-di-tert-butyl phenyl)-4,4'-biphenyl diphosphonite (Aldrich 46, 852-5), (32) 4-tert-amyl phenol (Aldrich 15, 384-2), (33) 3-(2H-benzotriazol-2-yl)-4-hydroxy phenethylalcohol (Aldrich 43, 071-4), NAUGARD 76, NAUGARD 445, NAUGARD 512, and NAUGARD 524 (manufactured by Uniroyal Chemical Company), (34) tris TPM antioxidant (bis(4-diethylamino-2-methylphenyl)-4-diethylaminophenylmethane).

Designing and tuning the fluorine content in the SOF compositions of the present disclosure is straightforward and neither requires synthesis of custom polymers, nor requires blending/dispersion procedures. Furthermore, the SOF compositions of the present disclosure may be SOF compositions in which the fluorine content is uniformly dispersed and patterned at the molecular level. Fluorine content in the SOFs of the present disclosure may be adjusted by changing the molecular building block used for SOF synthesis or by changing the amount of fluorine building block employed.

In embodiments, the fluorinated SOF may be made by the reaction of one or more suitable molecular building blocks, where at least one of the molecular building block segments comprises fluorine atoms.

In embodiments, the overcoat layer comprises a fluorinated SOF in which a first segment having hole transport properties, which may or may not be obtained from the reaction of a fluorinated building block, may be linked to a second segment that is fluorinated, such as a second segment that has been obtained from the reaction of a fluorine-containing molecular building block.

In embodiments, the fluorine content of the fluorinated SOFs comprised in the overcoat layer of the present disclosure may be homogeneously distributed throughout the SOF. The homogenous distribution of fluorine content in the SOF comprised in the overcoat layer of the present disclosure may be controlled by the SOF forming process and therefore the fluorine content may also be patterned at the molecular level.

In embodiments, the fluorinated SOFs may be made by the reaction of one or more molecular building blocks, where at least one of the molecular building blocks contains fluorine and at least one at least one of the molecular building blocks has charge transport molecule functions (or upon reaction results in a segment with hole transport molecule functions. For example, the reaction of at least one, or two or more molecular building blocks of the same or different fluorine content and hole transport molecule functions may be undertaken to produce a fluorinated SOF. In specific embodiments, all of the molecular building blocks in the reaction mixture may contain fluorine which may be used as the overcoat layer of the imaging members and/or photoreceptors of the present disclosure. In embodiments, a different halogen, such as chlorine, and may optionally be contained in the molecular building blocks.

The fluorinated molecular building blocks may be derived from one or more building blocks containing a carbon or silicon atomic core; building blocks containing alkoxy cores; building blocks containing a nitrogen or phosphorous atomic core; building blocks containing aryl cores; building blocks containing carbonate cores; building blocks containing carbocyclic-, carbobicyclic-, or carbotricyclic core; and building blocks containing an oligothiophene core. Such fluorinated molecular building blocks may be derived by replacing or exchanging one or more hydrogen atoms with a fluorine atom. In embodiments, one or more one or more of the above molecular building blocks may have all the carbon bound hydrogen atoms replaced by fluorine. In embodiments, one or more one or more of the above molecular building blocks may have one or more hydrogen atoms replaced by a different halogen, such as by chlorine. In addition to fluorine, the SOFs of the present disclosure may also include other halogens, such as chlorine.

In embodiments, one or more fluorinated molecular building blocks may be respectively present individually or totally in the fluorinated SOF comprised in the overcoat layer of the imaging members and/or photoreceptors of the present disclosure at a percentage of about 5 to about 100% by weight, such as at least about 50% by weight, or at least about 75% by weight, in relation to 100 parts by weight of the SOF.

In embodiments, the fluorinated SOF may have greater than about 20% of the H atoms replaced by fluorine atoms, such as greater than about 50%, greater than about 75%, greater than about 80%, greater than about 90%, or greater than about 95% of the H atoms replaced by fluorine atoms, or about 100% of the H atoms replaced by fluorine atoms.

In embodiments, the fluorine content of the fluorinated SOF comprised in the overcoat layer of the imaging members and/or photoreceptors of the present disclosure may be of from about 5% to about 75% by weight, such as about 5% to about 65% by weight, or about 40% to about 60% by weight.

In embodiments, the overcoat layer of the imaging members and/or photoreceptors of the present disclosure may comprise a first fluorinated segment and a second electroactive segment in the SOF of the outermost layer.

The first fluorinated segment may be present in the SOF of the outermost layer in an amount of from about 30% to about 70% by weight of the SOF, such as from about 40% to about 60% by weight of the SOF, or about 45% to about 55% by weight of the SOF.

Examples of the first fluorinated segment include, but are not limited to, 2,2,3,3,4,4,5,5-octafluoro-1,6-hexanediol, 2,2,3,3,4,4,5,5,6,6,7,7-dodecanfluoro-1,8-octanediol, 2,2,3,3,4,4,5,5,6,6,7,7,8,8,9,9-perfluorodecane-1,10-dial, (2,3,5,6-tetrafluoro-4-hydroxymethyl-phenyl)-methanol, 2,2,3,3-tetrafluoro-1,4-butanediol, 2,2,3,3,4,4-hexafluoro-1,5-pentanedial, and 2,2,3,3,4,4,5,5,6,6,7,7,8,8-tetradecafluoro-1,9-nonanediol.

The second electroactive segment may be present in the SOF of the outermost layer in an amount of from about 30% to about 70% by weight of the SOF, such as from about 40% to about 60% by weight of the SOF, or about 45% to about 55% by weight of the SOF.

In one embodiment, the second electroactive segment includes N4,N4,N4',N4'-tetrakis(4-(methoxymethyl)phenyl) biphenyl-4,4'-diamine

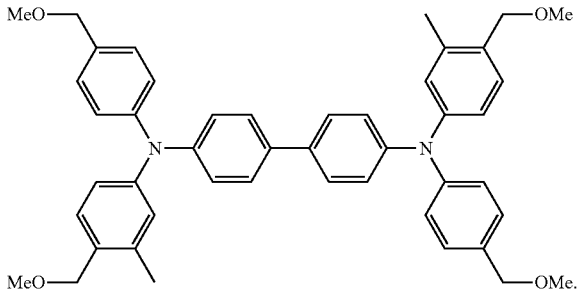

When a capping unit is introduced into the SOF, the SOF framework is locally 'interrupted' where the capping units are present. These SOF compositions are 'covalently doped' because a foreign molecule is bonded to the SOF framework when capping units are present. Capped SOF compositions may alter the properties of SOFs without changing constituent building blocks. For example, the mechanical and physical properties of the capped SOF where the SOF framework is interrupted may differ from that of an uncapped SOF. In embodiments, the capping unit may fluorinated which would result in a fluorinated SOF.

A description of various exemplary molecular building blocks, linkers, SOF types, capping groups, strategies to synthesize a specific SOF type with exemplary chemical structures, building blocks whose symmetrical elements are outlined, and classes of exemplary molecular entities and examples of members of each class that may serve as molecular building blocks for SOFs are detailed in U.S. patent application Ser. Nos. 12/716,524; 12/716,449; 12/716,706; 12/716,324; 12/716,686; 12/716,571; 12/815,688; 12/845,053; 12/845,235; 12/854,962; 12/854,957; and 12/845,052 entitled "Structured Organic Films," "Structured Organic Films Having an Added Functionality," "Mixed Solvent Process for Preparing Structured Organic Films," "Composite Structured Organic Films," "Process For Preparing Structured Organic Films (SOFs) Via a Pre-SOF," "Electronic Devices Comprising Structured Organic Films," "Periodic Structured Organic Films," "Capped Structured Organic Film Compositions," "Imaging Members Comprising Capped Structured. Organic Film Compositions," "Imaging Members for Ink-Based Digital Printing Comprising Structured Organic Films," "Imaging Devices Comprising Structured Organic Films," and "Imaging Members Comprising Structured Organic Films," respectively; and U.S. Provisional Application No. 61/157,411, entitled "Structured Organic Films" filed Mar. 4, 2009, the disclosures of which are totally incorporated herein by reference in their entireties.

In embodiments, fluorinated molecular building blocks may be obtained from the fluorination of any of the above "parent" non-fluorinated molecular building blocks (e.g., molecular building blocks detailed in U.S. patent application Ser. Nos. 12/716,524; 12/716,449; 12/716,706; 12/716,324; 12/716,686; 12/716,571; 12/815,688; 12/845,053; 12/845,235; 12/854,962; 12/854,957; and 12/845,052, previously incorporated by reference) by known processes. For example, "parent" non-fluorinated molecular building blocks may be fluorinated via elemental fluorine at elevated temperatures, such as greater than about 150° C., or by other known process steps to form a mixture of fluorinated molecular building blocks having varying degrees of fluorination, which may be optionally purified to obtain an individual fluorinated molecular building block. Alternatively, fluorinated molecular building blocks may be synthesized and/or obtained by simple purchase of the desired fluorinated molecular building block. The conversion of a "parent" non-fluorinated molecular building block into a fluorinated molecular building block may take place under reaction conditions that utilize a single set or range of known reaction conditions, and may be a known one step reaction or known multi-step reaction. Exemplary reactions may include one or more known reaction mechanisms, such as an addition and/or an exchange.

For example, the conversion of a parent non-fluorinated molecular building block into a fluorinated molecular building block may comprise contacting a non-fluorinated molecular building block with a known dehydrohalogenation agent to produce a fluorinated molecular building block. In embodiments, the dehydrohalogenation step may be carried out under conditions effective to provide a conversion to replace at least about 50% of the H atoms, such as carbon-bound hydrogens, by fluorine atoms, such as greater than about 60%, greater than about 75%, greater than about 80%, greater than about 90%, or greater than about 95% of the H atoms, such as carbon-bound hydrogens, replaced by fluorine atoms, or about 100% of the H atoms replaced by fluorine atoms, in non-fluorinated molecular building block with fluorine. In embodiments, the dehydrohalogenation step may be carried out under conditions effective to provide a conversion that replaces at least about 99% of the hydrogens, such as carbon-bound hydrogens, in non-fluorinated molecular building block with fluorine. Such a reaction may be carried out in the liquid phase or in the gas phase, or in a combination of gas and liquid phases, and it is contemplated that the reaction can be carried out batch wise, continuous, or a combination of these. Such a reaction may be carried out in the presence of catalyst, such as activated carbon. Other catalysts may be used, either alone or in conjunction one another or depending on the requirements of particular molecular building block being fluorinated, including for example palladium-based catalyst, platinum-based catalysts, rhodium-based catalysts and ruthenium-based catalysts.

Molecular Building Block

The SOFs of the present disclosure comprise molecular building blocks having a segment (S) and functional groups (Fg). Molecular building blocks require at least two functional groups ($x \geq 2$) and may comprise a single type or two or more types of functional groups. Functional groups are the reactive chemical moieties of molecular building blocks that participate in a chemical reaction to link together segments during the SOF forming process. A segment is the portion of the molecular building block that supports functional groups and comprises all atoms that are not associated with functional groups. Further, the composition of a molecular building block segment remains unchanged after SOF formation.

Functional Group

Functional groups are the reactive chemical moieties of molecular building blocks that participate in a chemical reaction to link together segments during the SOF forming process. Functional groups may be composed of a single atom, or functional groups may be composed of more than one atom. The atomic compositions of functional groups are those compositions normally associated with reactive moieties in chemical compounds. Non-limiting examples of functional groups include halogens, alcohols, ethers, ketones, carboxylic acids, esters, carbonates, amines, amides, imines, ureas, aldehydes, isocyanates, tosylates, alkenes, alkynes and the like.

Molecular building blocks contain a plurality of chemical moieties, but only a subset of these chemical moieties are intended to be functional groups during the SOF forming process. Whether or not a chemical moiety is considered a functional group depends on the reaction conditions selected for the SOF forming process. Functional groups (Fg) denote a chemical moiety that is a reactive moiety, that is, a functional group during the SOF forming process.

In the SOF forming process, the composition of a functional group will be altered through the loss of atoms, the gain of atoms, or both the loss and the gain of atoms; or, the functional group may be lost altogether. In the SOF, atoms previously associated with functional groups become associated with linker groups, which are the chemical moieties that join together segments. Functional groups have characteristic chemistries and those of ordinary skill in the art can generally recognize in the present molecular building blocks the atom(s) that constitute functional group(s). It should be noted that an atom or grouping of atoms that are identified as part of the molecular building block functional group may be preserved in the linker group of the SOF. Linker groups are described below.

Capping Unit

Capping units of the present disclosure are molecules that 'interrupt' the regular network of covalently bonded building blocks normally present in an SOF. Capped SOF compositions are tunable materials whose properties can be varied through the type and amount of capping unit introduced. Capping units may comprise a single type or two or more types of functional groups and/or chemical moieties.

In embodiments, the SOF comprises a plurality of segments, where all segments have an identical structure, and a plurality of linkers, which may or may not have an identical structure, wherein the segments that are not at the edges of the SOF are connected by linkers to at least three other segments and/or capping groups. In embodiments, the SOF comprises a plurality of segments where the plurality of segments comprises at least a first and a second segment that are different in structure, and the first segment is connected by linkers to at least three other segments and/or capping groups when it is not at the edge of the SOF.

In embodiments, the SOF comprises a plurality of linkers including at least a first and a second linker that are different in structure, and the plurality of segments either comprises at least a first and a second segment that are different in structure, where the first segment, when not at the edge of the SOF, is connected to at least three other segments and/or capping groups, wherein at least one of the connections is via the first linker, and at least one of the connections is via the second linker; or comprises segments that all have an identical structure, and the segments that are not at the edges of the SOF are connected by linkers to at least three other segments and/or capping groups, wherein at least one of the connections is via the first linker, and at least one of the connections is via the second linker.

Segment

A segment is the portion of the molecular building block that supports functional groups and comprises all atoms that are not associated with functional groups. Further, the composition of a molecular building block segment remains unchanged after SOF formation. In embodiments, the SOF may contain a first segment having a structure the same as or different from a second segment. In other embodiments, the structures of the first and/or second segments may be the same as or different from a third segment, forth segment, fifth segment, etc. A segment is also the portion of the molecular building block that can provide an inclined property. Inclined properties are described later in the embodiments.

The SOF of the present disclosure comprise a plurality of segments including at least a first segment type and a plurality of linkers including at least a first linker type arranged as a covalent organic framework (COF) having a plurality of pores, wherein the first segment type and/or the first linker type comprises at least one atom that is not carbon. In embodiments, the segment (or one or more of the segment types included in the plurality of segments making up the SOF) of the SOF comprises at least one atom of an element that is not carbon, such as where the structure of the segment comprises at least one atom selected from the group consisting of hydrogen, oxygen, nitrogen, silicon, phosphorous, selenium, fluorine, boron, and sulfur.

A description of various exemplary molecular building blocks, linkers, SOF types, strategies to synthesize a specific SOF type with exemplary chemical structures, building blocks whose symmetrical elements are outlined, and classes of exemplary molecular entities and examples of members of each class that may serve as molecular building blocks for SOFs are detailed in U.S. patent application Ser. Nos. 12/716,524; 12/716,449; 12/716,706; 12/716,324; 12/716,686; 12/716,571; 12/815,688; 12/845,053; 12/845,235; 12/854,962; 12/854,957; 12/845,052, 13/042,950, 13/173,948, 13/181,761, 13/181,912, 13/174,046, and 13/182,047, the disclosures of which are totally incorporated herein by reference in their entireties.

Linker

A linker is a chemical moiety that emerges in a SOF upon chemical reaction between functional groups present on the molecular building blocks and/or capping unit.

A linker may comprise a covalent bond, a single atom, or a group of covalently bonded atoms. The former is defined as a covalent bond linker and may be, for example, a single covalent bond or a double covalent bond and emerges when functional groups on all partnered building blocks are lost entirely. The latter linker type is defined as a chemical moiety linker and may comprise one or more atoms bonded together by single covalent bonds, double covalent bonds, or combinations of the two. Atoms contained in linking groups originate from atoms present in functional groups on molecular building blocks prior to the SOF forming process. Chemical moiety linkers may be well-known chemical groups such as, for example, esters, ketones, amides, imines, ethers, urethanes, carbonates, and the like, or derivatives thereof.

For example, when two hydroxyl (—OH) functional groups are used to connect segments in a SOF via an oxygen atom, the linker would be the oxygen atom, which may also be described as an ether linker. In embodiments, the SOF may contain a first linker having a structure the same as or different from a second linker. In other embodiments, the structures of the first and/or second linkers may be the same as or different from a third linker, etc.

The SOF of the present disclosure comprise a plurality of segments including at least a first segment type and a plurality of linkers including at least a first linker type arranged as a covalent organic framework (COF) having a plurality of pores, wherein the first segment type and/or the first linker type comprises at least one atom that is not carbon. In embodiments, the linker (or one or more of the plurality of linkers) of the SOF comprises at least one atom of an element that is not carbon, such as where the structure of the linker comprises at least one atom selected from the group consisting of hydrogen, oxygen, nitrogen, silicon, phosphorous, selenium, fluorine, boron, and sulfur.

In embodiments, fluorinated SOFs with electroactive added functionality may be prepared by reacting fluorinated molecular building blocks with molecular building blocks with inclined electroactive properties and/or molecular building blocks that result in electroactive segments resulting from the assembly of conjugated segments and linkers. In embodiments, the fluorinated SOF comprised in the outermost layer of the imaging members and/or photoreceptors of the present disclosure may be made by preparing a reaction mixture containing at least one fluorinated building block and at least one building block having electroactive properties, such as hole transport molecule functions, such HTM segments may those described below such as N,N,N',N'-tetrakis-[(4-hydroxymethyl)phenyl]-biphenyl-4,4'-diamine, having a hydroxyl functional group (—OH) and upon reaction results in a segment of N,N,N',N'-tetra-(p-tolyl)biphenyl-4,4'-diamine; and/or N,N'-diphenyl-N,N'-bis-(3-hydroxyphenyl)-biphenyl-4,4'-diamine, having a hydroxyl functional group (—OH) and upon reaction results in a segment of N,N,N',N'-tetraphenyl-biphenyl-4,4'-diamine. The following sections describe further molecular building blocks and/or the resulting segment core with inclined hole transport properties, inclined electron transport properties, and inclined semiconductor properties, that may be reacted with fluorinated building blocks (described above) to produce the fluorinated SOF comprised in the outermost layer of the imaging members and/or photoreceptors of the present disclosure.

SOFs with hole transport added functionality may be obtained by selecting segment cores such as, for example, triarylamines, hydrazones (U.S. Pat. No. 7,202,002 B2 to Tokarski et al.), and enamines (U.S. Pat. No. 7,416,824 B2 to Kondoh et al.) with the following general structures:

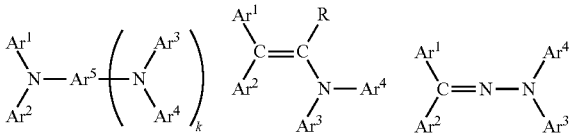

triarylamine enamines hydrazones

The segment core comprising a triarylamine being represented by the following general formula:

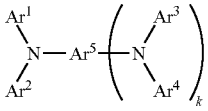

wherein Ar1, Ar2, Ar3, Ar4 and Ar5 each independently represents a substituted or unsubstituted aryl group, or Ar5 independently represents a substituted or unsubstituted arylene group, and k represents 0 or 1, wherein at least two of Ar1, Ar2, Ar3, Ar4 and Ar5 comprises a Fg (previously defined). Ar5 may be further defined as, for example, a substituted phenyl ring, substituted/unsubstituted phenylene, substituted/unsubstituted monovalently linked aromatic rings such as biphenyl, terphenyl, and the like, or substituted/unsubstituted fused aromatic rings such as naphthyl, anthranyl, phenanthryl, and the like.

Segment cores comprising arylamines with hole transport added functionality include, for example, aryl amines such as triphenylamine, N,N,N',N'-tetraphenyl-(1,1'-biphenyl)-4,4'-diamine, N,N-diphenyl-N,N'-bis(3-methylphenyl)-(1,1'-biphenyl)-4,4'-diamine, N,N'-bis(4-butylphenyl)-N,N'-diphenyl-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like.

The segment core comprising a hydrazone being represented by the following general formula:

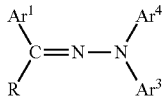

wherein Ar1, Ar2, and Ar3 each independently represents an aryl group optionally containing one or more substituents, and R represents a hydrogen atom, an aryl group, or an alkyl group optionally containing a substituent; wherein at least two of Ar1, Ar2, and Ar3 comprises a Fg (previously defined); and a related oxadiazole being represented by the following general formula:

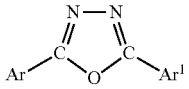

wherein Ar and Ar1 each independently represent an aryl group that comprises a Fg (previously defined).

The segment core comprising an enamine being represented by the following general formula:

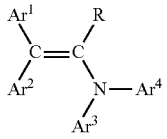

wherein Ar1, Ar2, Ar3, and Ar4 each independently represents an aryl group that optionally contains one or more substituents or a heterocyclic group that optionally contains one or more substituents, and R represents a hydrogen atom, an aryl group, or an alkyl group optionally containing a substituent; wherein at least two of Ar1, Ar2, Ar3, and Ar4 comprises a Fg (previously defined).

The SOF may be a p-type semiconductor, n-type semiconductor or ambipolar semiconductor. The SOF semiconductor type depends on the nature of the molecular building blocks. Molecular building blocks that possess an electron donating property such as alkyl, alkoxy, aryl, and amino groups, when present in the SOF, may render the SOF a p-type semiconductor. Alternatively, molecular building blocks that are electron withdrawing such as cyano, nitro, fluoro, fluorinated alkyl, and fluorinated aryl groups may render the SOF into the n-type semiconductor.

Similarly, the electroactivity of SOFs prepared by these molecular building blocks will depend on the nature of the segments, nature of the linkers, and how the segments are orientated within the SOF. Linkers that favor preferred orientations of the segment moieties in the SOF are expected to lead to higher electroactivity.

Process for Preparing a Fluorinated Structured Organic Film (SOF)

The process for making SOFs of the present disclosure, such as fluorinated SOFs, typically comprises a number of activities or steps (set forth below) that may be performed in any suitable sequence or where two or more activities are performed simultaneously or in close proximity in time:

A process for preparing a SOF comprising:

(a) preparing a liquid-containing reaction mixture comprising a plurality of molecular building blocks, each comprising a segment (where at least one segment may comprise fluorine and at least one of the resulting segments is electroactive, such as an HTM) and a number of functional groups, and an anti-oxidant, and a leveling agent, and a non-linker HTM, and optionally a pre-SOF;

(b) depositing the reaction mixture as a wet film;

(c) promoting a change of the wet film including the molecular building blocks to a dry film comprising the SOF comprising a plurality of the segments and a plurality of linkers arranged as a covalent organic framework, wherein at a macroscopic level the covalent organic framework is a film;

(d) optionally removing the SOF from the substrate to obtain a free-standing SOF;

(e) optionally processing the free-standing SOF into a roll;

(f) optionally cutting and seaming the SOF into a belt; and (g) optionally performing the above SOF formation process (es) upon an SOF (which was prepared by the above SOF formation process(es)) as a substrate for subsequent SOF formation process(es).

The process for making capped SOFs and/or composite SOFs typically comprises a similar number of activities or steps (set forth above) that are used to make a non-capped SOF. The capping unit and/or secondary component may be added during either step a, b or c, depending the desired distribution of the capping unit in the resulting SOF. For example, if it is desired that the capping unit and/or secondary component distribution is substantially uniform over the resulting SOF, the capping unit may be added during step a. Alternatively, if, for example, a more heterogeneous distribution of the capping unit and/or secondary component is desired, adding the capping unit and/or secondary component (such as by spraying it on the film formed during step b or during the promotion step of step c) may occur during steps b and c.

The above activities or steps may be conducted at atmospheric, super atmospheric, or subatmospheric pressure. The term "atmospheric pressure" as used herein refers to a pressure of about 760 torr. The term "super atmospheric" refers to pressures greater than atmospheric pressure, but less than 20 atm. The term "subatmospheric pressure" refers to pressures less than atmospheric pressure. In an embodiment, the activities or steps may be conducted at or near atmospheric pressure. Generally, pressures of from about 0.1 atm to about 2 atm, such as from about 0.5 atm to about 1.5 atm, or 0.8 atm to about 1.2 atm may be conveniently employed.

Process Action A: Preparation of the Liquid-Containing Reaction Mixture

The reaction mixture comprises a plurality of molecular building blocks that are dissolved, suspended, or mixed in a liquid, such building blocks may include, for example, at least one fluorinated building block, and at least one electroactive building block, such as, for example, N,N,N',N'-tetrakis-[(4-hydroxymethyl)phenyl]-biphenyl-4,4'-diamine, having a hydroxyl functional group (—OH) and a segment of N,N,N',N'-tetra-(p-tolyl)biphenyl-4,4'-diamine, and/or N,N'-diphenyl-N,N'-bis-(3-hydroxyphenyl)-biphenyl-4,4'-diamine, having a hydroxyl functional group (—OH) and a segment of N,N,N',N'-tetraphenyl-biphenyl-4,4'-diamine. The plurality of molecular building blocks may be of one type or two or more types. When one or more of the molecular building blocks is a liquid, the use of an additional liquid is optional. Catalysts may optionally be added to the reaction mixture to enable SOF formation or modify the kinetics of SOF formation during Action C described above. Additives or secondary components may optionally be added to the reaction mixture to alter the physical properties of the resulting SOF.

The reaction mixture components (molecular building blocks, optionally a capping unit, liquid (solvent), optionally catalysts, and optionally additives) are combined (such as in a vessel). The order of addition of the reaction mixture components may vary; however, typically the catalyst is added last. In particular embodiments, the molecular building blocks are heated in the liquid in the absence of the catalyst to aid the dissolution of the molecular building blocks. The reaction mixture may also be mixed, stirred, milled, or the like, to ensure even distribution of the formulation components prior to depositing the reaction mixture as a wet film.

In embodiments, the reaction mixture may be heated prior to being deposited as a wet film. This may aid the dissolution of one or more of the molecular building blocks and/or increase the viscosity of the reaction mixture by the partial reaction of the reaction mixture prior to depositing the wet layer. This approach may be used to increase the loading of the molecular building blocks in the reaction mixture.

In particular embodiments, the reaction mixture needs to have a viscosity that will support the deposited wet layer. Reaction mixture viscosities range from about 10 to about 50,000 cps, such as from about 25 to about 25,000 cps or from about 50 to about 1000 cps.

The molecular building block and capping unit loading or "loading" in the reaction mixture is defined as the total weight of the molecular building blocks and optionally the capping units and catalysts divided by the total weight of the reaction mixture. Building block loadings may range from about 10 to 50%, such as from, about 20 to about 40%, or from about 25 to about 30%. The capping unit loading may also be chosen, so as to achieve the desired loading of the capping group. For example, depending on when the capping unit is to be added to the reaction mixture, capping unit loadings may range, by weight, less than about 30% by weight of the total building block loading, such as from about 0.5% to about 20% by weight of the total building block loading, or from about 1% to about 10% by weight of the total building block loading.

In embodiments, the theoretical upper limit for capping unit molecular building loading in the reaction mixture (liquid SOF formulation) is the molar amount of capping units that reduces the number of available linking groups to 2 per molecular building block in the liquid SOF formulation. In such a loading, substantial SOF formation may be effectively inhibited by exhausting (by reaction with the respective capping group) the number of available linkable functional groups per molecular building block. For example, in such a situation (where the capping unit loading is in an amount sufficient to ensure that the molar excess of available linking groups is less than 2 per molecular building block in the liquid SOF formulation), oligomers, linear polymers, and molecular building blocks that are fully capped with capping units may predominately form instead of an SOF.

In embodiments, the wear rate of the dry SOF of the imaging member or a particular layer of the imaging member may be adjusted or modulated by selecting a predetermined building block or combination of building block loading of the SOF liquid formulation. In embodiments, the wear rate of the imaging member may be from about 5 to about 20 nanometers per kilocycle rotation or from about 7 to about 12 nanometers per kilocycle rotation in an experimental fixture.

The wear rate of the dry SOF of the imaging member or a particular layer of the imaging member may also be adjusted or modulated by inclusion of capping unit and/or secondary component with the predetermined building block or combination of building block loading of the SOF liquid formulation. In embodiments, an effective secondary component and/or capping unit and/or effective capping unit and/or secondary component concentration in the dry SOF may be selected to either decrease the wear rate of the imaging member or increase the wear rate of the imaging member. In embodiments, the wear rate of the imaging member may be decreased by at least about 2% per 1000 cycles, such as by at least about 5% per 100 cycles, or at least 10% per 1000 cycles relative to a non-capped SOF comprising the same segment(s) and linker(s).

In embodiments, the wear rate of the imaging member may be increased by at least about 5% per 1000 cycles, such as by at least about 10% per 1000 cycles, or at least 25% per 1000 cycles relative to a non-capped SOF comprising the same segment(s) and linker(s).

Liquids used in the reaction mixture may be pure liquids, such as solvents, and/or solvent mixtures. Liquids are used to dissolve or suspend the molecular building blocks and catalyst/modifiers in the reaction mixture. Liquid selection is generally based on balancing the solubility/dispersion of the molecular building blocks and a particular building block loading, the viscosity of the reaction mixture, and the boiling point of the liquid, which impacts the promotion of the wet layer to the dry SOF. Suitable liquids may have boiling points from about 30 to about 300° C., such as from about 65° C. to about 250° C., or from about 100° C. to about 180° C.

Liquids can include molecule classes such as alkanes (hexane, heptane, octane, nonane, decane, cyclohexane, cycloheptane, cyclooctane, decalin); mixed alkanes (hexanes, heptanes); branched alkanes (isooctane); aromatic compounds (toluene, o-, m-, p-xylene, mesitylene, nitrobenzene, benzonitrile, butylbenzene, aniline); ethers (benzyl ethyl ether, butyl ether, isoamyl ether, propyl ether); cyclic ethers (tetrahydrofuran, dioxane), esters (ethyl acetate, butyl acetate, butyl butyrate, ethoxyethyl acetate, ethyl propionate, phenyl acetate, methyl benzoate); ketones (acetone, methyl ethyl ketone, methyl isobutylketone, diethyl ketone, chloroacetone, 2-heptanone), cyclic ketones (cyclopentanone, cyclohexanone), amines (1°, 2°, or 3° amines such as butylamine, diisopropylamine, triethylamine, diisoproylethylamine; pyridine); amides (dimethylformamide, N-methylpyrrolidinone, N,N-dimethylformamide); alcohols (methanol, ethanol, n-, i-propanol, n-, t-butanol, 1-methoxy-2-propanol, hexanol, cyclohexanol, 3-pentanol, benzyl alcohol); nitriles (acetonitrile, benzonitrile, butyronitrile), halogenated aromatics (chlorobenzene, dichlorobenzene, hexafluorobenzene), halogenated alkanes (dichloromethane, chloroform, dichloroethylene, tetrachloroethane); and water.

Mixed liquids comprising a first solvent, second solvent, third solvent, and so forth may also be used in the reaction mixture. Two or more liquids may be used to aid the dissolution/dispersion of the molecular building blocks; and/or increase the molecular building block loading; and/or allow a stable wet film to be deposited by aiding the wetting of the substrate and deposition instrument; and/or modulate the promotion of the wet layer to the dry SOF. In embodiments, the second solvent is a solvent whose boiling point or vapor-pressure curve or affinity for the molecular building blocks differs from that of the first solvent. In embodiments, a first solvent has a boiling point higher than that of the second solvent. In embodiments, the second solvent has a boiling point equal to or less than about 100° C., such as in the range of from about 30° C. to about 100° C., or in the range of from about 40° C. to about 90° C., or about 50° C. to about 80° C.

The ratio of the mixed liquids may be established by one skilled in the art. The ratio of liquids a binary mixed liquid may be from about 1:1 to about 99:1, such as from about 1:10 to about 10:1, or about 1:5 to about 5:1, by volume. When n liquids are used, with n ranging from about 3 to about 6, the amount of each liquid ranges from about 1% to about 95% such that the sum of each liquid contribution equals 100%.

The term "substantially removing" refers to, for example, the removal of at least 90% of the respective solvent, such as about 95% of the respective solvent. The term "substantially leaving" refers to, for example, the removal of no more than 2% of the respective solvent, such as removal of no more than 1% of the respective solvent.

These mixed liquids may be used to slow or speed up the rate of conversion of the wet layer to the SOF in order to manipulate the characteristics of the SOFs. For example, in condensation and addition/elimination linking chemistries, liquids such as water, 1°, 2°, or 3° alcohols (such as methanol, ethanol, propanol, isopropanol, butanol, 1-methoxy-2-propanol, tert-butanol) may be used.

Optionally a catalyst may be present in the reaction mixture to assist the promotion of the wet layer to the dry SOF. Selection and use of the optional catalyst depends on the functional groups on the molecular building blocks. Catalysts may be homogeneous (dissolved) or heterogeneous (undissolved or partially dissolved) and include Brönsted acids (HCl (aq), acetic acid, p-toluenesulfonic acid, amine-protected p-toluenesulfonic acid such as pyrridium p-toluenesulfonate, trifluoroacetic acid); Lewis acids (boron trifluoroetherate, aluminum trichloride); Brönsted bases (metal hydroxides such as sodium hydroxide, lithium hydroxide, potassium hydroxide; 1°, 2', or 3° amines such as butylamine, diisopropylamine, triethylamine, diisoproylethylamine); Lewis bases (N,N-dimethyl-4-aminopyridine); metals (Cu bronze); metal salts (FeCl3, AuCl3); and metal complexes (ligated palladium complexes, ligated ruthenium catalysts). Typical catalyst loading ranges from about 0.01% to about 25%, such as from about 0.1% to about 5% of the molecular building block loading in the reaction mixture. The catalyst may or may not be present in the final SOF composition.

Optionally additives or secondary components, such as dopants, may be present in the reaction mixture and wet layer. Such additives or secondary components may also be integrated into a dry SOF. Additives or secondary components can be homogeneous or heterogeneous in the reaction mixture and wet layer or in a dry SOF. In contrast to capping units, the terms "additive" or "secondary component," refer, for example, to atoms or molecules that are not covalently bound in the SOF, but are randomly distributed in the composition. Suitable secondary components and additives are described in U.S. patent application Ser. No. 12/716,324, entitled "Composite Structured Organic Films," the disclosure of which is totally incorporated herein by reference in its entirety.

Process Action B: Depositing the Reaction Mixture as a Wet Film

The reaction mixture may be applied as a wet film to a variety of substrates using a number of liquid deposition techniques. The thickness of the SOF is dependant on the thickness of the wet film and the molecular building block loading in the reaction mixture. The thickness of the wet film is dependent on the viscosity of the reaction mixture and the method used to deposit the reaction mixture as a wet film.

Substrates include, for example, polymers, papers, metals and metal alloys, doped and undoped forms of elements from Groups III-VI of the periodic table, metal oxides, metal chalcogenides, and previously prepared SOFs or capped SOFs. Examples of polymer film substrates include polyesters, polyolefins, polycarbonates, polystyrenes, polyvinylchloride, block and random copolymers thereof, and the like. Examples of metallic surfaces include metallized polymers, metal foils, metal plates; mixed material substrates such as metals patterned or deposited on polymer, semiconductor, metal oxide, or glass substrates. Examples of substrates comprised of doped and undoped elements from Groups of the periodic table include, aluminum, silicon, silicon n-doped with phosphorous, silicon p-doped with boron, tin, gallium arsenide, lead, gallium indium phosphide, and indium. Examples of metal oxides include silicon dioxide, titanium dioxide, indium tin oxide, tin dioxide, selenium dioxide, and alumina. Examples of metal chalcogenides include cadmium sulfide, cadmium telluride, and zinc selenide. Additionally, it is appreciated that chemically treated or mechanically modified forms of the above substrates remain within the scope of surfaces which may be coated with the reaction mixture.

In embodiments, the substrate may be composed of, for example, silicon, glass plate, plastic film or sheet. For structurally flexible devices, a plastic substrate such as polyester, polycarbonate, polyimide sheets and the like may be used. The thickness of the substrate may be from around 10 micrometers to over 10 millimeters with an exemplary thickness being from about 50 to about 100 micrometers, especially for a flexible plastic substrate, and from about 1 to about 10 millimeters for a rigid substrate such as glass or silicon.

The reaction mixture may be applied to the substrate using a number of liquid deposition techniques including, for example, spin coating, blade coating, web coating, dip coating, cup coating, rod coating, screen printing, ink jet printing, spray coating, stamping and the like. The method used to deposit the wet layer depends on the nature, size, and shape of the substrate and the desired wet layer thickness. The thickness of the wet layer can range from about 10 nm to about 5 mm, such as from about 100 nm to about 1 mm, or from about 1 μm to about 500 μM.

In embodiments, the capping unit and/or secondary component may be introduced following completion of the above described process action B. The incorporation of the capping unit and/or secondary component in this way may be accomplished by any means that serves to distribute the capping unit and/or secondary component homogeneously, heterogeneously, or as a specific pattern over the wet film. Following introduction of the capping unit and/or secondary component subsequent process actions may be carried out resuming with process action C.

For example, following completion of process action B (i.e., after the reaction mixture may be applied to the substrate), capping unit(s) and/or secondary components (dopants, additives, etc.) may be added to the wet layer by any suitable method, such as by distributing (e.g., dusting, spraying, pouring, sprinkling, etc, depending on whether the capping unit and/or secondary component is a particle, powder or liquid) the capping unit(s) and/or secondary component on the top the wet layer. The capping units and/or secondary components may be applied to the formed wet layer in a homogeneous or heterogeneous manner, including various patterns, wherein the concentration or density of the capping unit(s) and/or secondary component is reduced in specific areas, such as to form a pattern of alternating bands of high and low concentrations of the capping unit(s) and/or secondary component of a given width on the wet layer. In embodiments, the application of the capping unit(s) and/or secondary component to the top of the wet layer may result in a portion of the capping unit(s) and/or secondary component diffusing or sinking into the wet layer and thereby forming a heterogeneous distribution of capping unit(s) and/or secondary component within the thickness of the SOF, such that a linear or nonlinear concentration gradient may be obtained in the resulting SOF obtained after promotion of the change of the wet layer to a dry SOF. In embodiments, a capping unit(s) and/or secondary component may be added to the top surface of a deposited wet layer, which upon promotion of a change in the wet film, results in an SOF having an heterogeneous distribution of the capping unit(s) and/or secondary component in the dry SOF. Depending on the density of the wet film and the density of the capping unit(s) and/or secondary component, a majority of the capping unit(s) and/or secondary component may end up in the upper half (which is opposite the substrate) of the dry SOF or a majority of the capping unit(s) and/or secondary component may end up in the lower half (which is adjacent to the substrate) of the dry SOF.

Process Action C: Promoting the Change of Wet Film to the Dry SOF

The term "promoting" refers, for example, to any suitable technique to facilitate a reaction of the molecular building blocks, such as a chemical reaction of the functional groups of the building blocks. In the case where a liquid needs to be removed to form the dry film, "promoting" also refers to removal of the liquid. Reaction of the molecular building blocks (and optionally capping units), and removal of the liquid can occur sequentially or concurrently. In embodiments, the capping unit and/or secondary component may be added while the promotion of the change of the wet film to the dry SOF is occurring. In certain embodiments, the liquid is also one of the molecular building blocks and is incorporated into the SOF. The term "dry SOF" refers, for example, to substantially dry SOFs (such as capped and/or composite SOFs), for example, to a liquid content less than about 5% by weight of the SOF, or to a liquid content less than 2% by weight of the SOF.

In embodiments, the dry SOF or a given region of the dry SOF (such as the surface to a depth equal to of about 10% of the thickness of the SOF or a depth equal to of about 5% of the thickness of the SOF, the upper quarter of the SOF, or the regions discussed above) the capping units are present in an amount equal to or greater than about 0.5%, by mole, with respect to the total moles of capping units and segments present, such as from about 1% to about 40%, or from about 2% to 25% by mole, with respect to the total moles of capping units and segments present. For example when the capping units are present in an amount of about 0.5% by mole respect to the total moles of capping units and segments present, there would be about 0.05 mols of capping units and about 9.95 mols of segments present in the sample.

Promoting the wet layer to form a dry SOF may be accomplished by any suitable technique. Promoting the wet layer to form a dry SOF typically involves thermal treatment including, for example, oven drying, infrared radiation (IR), and the like with temperatures ranging from 40 to 350° C. and from 60 to 200° C. and from 85 to 160° C. The total heating time can range from about four seconds to about 24 hours, such as from one minute to 120 minutes, or from three minutes to 60 minutes.

IR promotion of the wet layer to the COF film may be achieved using an IR heater module mounted over a belt transport system. Various types of IR emitters may be used, such as carbon IR emitters or short wave IR emitters (available from Heraerus). Additional exemplary information regarding carbon IR emitters or short wave IR emitters is summarized in Table 1 below.

TABLE 1

| IR lamp | Peak Wavelength | Number of lamps | Module Power (kW) |
|---|---|---|---|
| Carbon | 2.0 micron | 2-twin tube | 4.6 |
| Short wave | 1.2-1.4 micron | 2-twin tube | 4.5 |

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter.

To demonstrate the advantage of a hole transport molecule of the present embodiments, e.g., bis [4-(methoxymethyl) phenyl] phenylamine, the following examples were fabricated and tested for LCM, wear rate, print testing, and surface roughness.

Example 1

Synthesis of a Fluorinated Structured Organic Film (FSOF) Containing BNX® TAHQ Antioxidant BNX®TAHQ (commercially available from Mayzo, Inc. BNX®TAHQ is a sterically hindered dihydroxybenzene antioxidant. The chemical name for BNX®TAHQ is 2,5-di (tert-amyl) hydroquinone.

A FSOF solution is made by mixing a first building block 1H,1H,8H,8H-dodecafluoro-1,8-octanediol; (9.83 g), a second building block TME-Ab118; (9.41 g); an anti-oxidant 2,5-di(tert-amyl) hydroquinone (BNX®TAHQ) (0.19 g); an acid catalyst delivered as 1.0 g of a 20 wt % solution of Nacure XP-357, a leveling additive delivered as 0.8 g of a 25 wt % solution of Silclean 3700, and 28.6 g of 1-methoxy-2-propanol.

The mixture was shaken and heated at 65° C. for 3 hours, which dissolves the solid constituents and reacts the building blocks together to form a structured network. The resulting mixture was then filtered through a 1 micron PTFE membrane and was tsukiagi cup coated onto a production Olympia 40 mm drum and dried in a forced air oven at 155° C. for 40 minutes. The resulting cured FSOF overcoat layer was ~6 microns thick.

Example 2

Synthesis of a Fluorinated Structured Organic Film (FSOF) Containing Tris TPM Antioxidant The same experimental procedure was carried out as described in Example 1, except that 0.36 g of Tris TPM antioxidant was used in place of 2,5-di(tert-amyl) hydroquinone (BNX®TAHQ).

Example 3

Synthesis of a Fluorinated Structured Organic Film (FSOF) Containing Tris TPM Antioxidant and Bis [4-(Methoxymethyl) Phenyl] Phenylamine A FSOF solution is made by mixing a first building block 1H,1H,8H,8H-dodecafluoro-1,8-octanediol; (7.49), a second building block TME-Ab118; (6.37); an anti-oxidant TrisTPM; (0.29 g); an HTM bis [4-(methoxymethyl) phenyl] phenylamine; (1.53 g), an acid catalyst delivered as 0.8 g of a 20 wt % solution of Nacure XP-357, a leveling additive delivered as 0.64 g of a 25 wt % solution of Silclean 3700, and 22.7 g of 1-methoxy-2-propanol.

Example 4

Control Experiment

The same experimental procedure was carried out as described in Examples 1-3 except that no overcoat layer is used.

Table 1 below summarizes the proportions of the ingredient/reactant used in the synthesis of the FSOF in Examples 1 to 3.

| | Percent Weight (%) | | | | | | | |
|---|---|---|---|---|---|---|---|---|
| Type | Charge transport molecule | Diol Linker | Charge Transport Molecule | Catalyst | Leveling | Additive | Solvent | wt % solid |
| Compound | N4,N4,N4',N4'-tetrakis(4-(methoxymethyl)phenyl)biphenyl-4,4'-diamine | octafluoro-1,6-hexanediol | AE139 | Nacure XP-357 | Silclean 3700 | See below | Dowanol PM | |
| Example 1 | 47.00% | 50.00% | | 1.00% | 1.00% | BNX: 1.00% | n/a | 43% |

-continued

| Percent Weight (%) | | | | | | | | |
|---|---|---|---|---|---|---|---|---|
| Type | Charge transport molecule | Diol Linker | Charge Transport Molecule | Catalyst | Leveling | Additive | Solvent | wt % solid |
| Example 2 | 47.00% | 49.00% | | 1.00% | 1.00% | Tris-TPM: 1.80% | n/a | 43% |
| Example 3 | 40.00% | 46.00% | 10.00% | 1.00% | 1.00% | Tris-TPM: 1.80% | n/a | 43% |

Example 5

Lateral Charge Migration

All drums were then tested for LCM using a Hyper Mode Test (HMT) corona exposure system along with interval printing of 1-5 bit line prints on a Pinot printer platform. Bit lines disappear with increasing corona exposure [HMT cycles]. As shown the addition of bis [4-(methoxymethyl) phenyl] phenylamine (AE139) in Example 3 produces exceptional long term LCM resistance up to 80,000 HMT cycles and surpasses the performance of Example 2 without AE139. FIG. 1 demonstrates the improved lateral charge migration results which support long term (80K cycles) usage when incorporating AE139 additive into the fluorinated SOF.

Example 6

Electrical Evaluation

Figure 2:
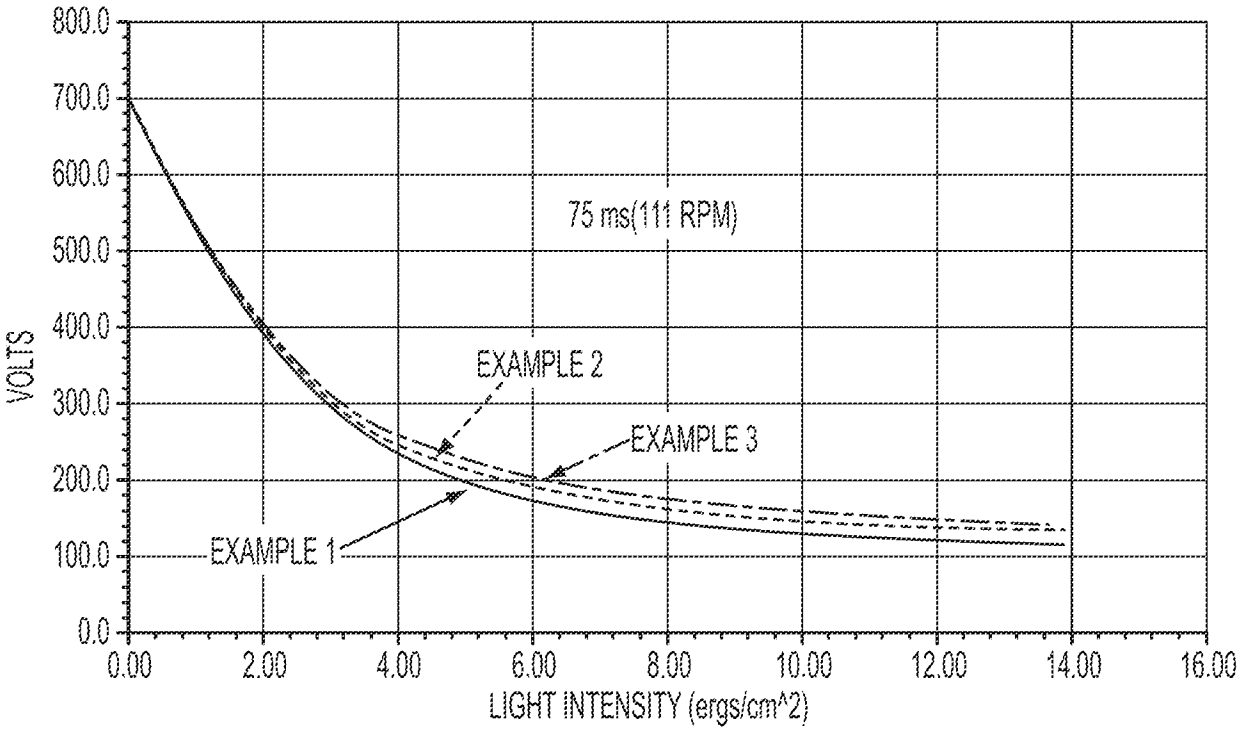
FIG. 2 is a graph of the PIDC data illustrating photoconductors including overcoat layers of the present embodiments show no impact on electrical performance compared to the photoconductors including overcoat layers with traditional "Structured organic films" (SOF).

Comparative Example 4 with no overcoat layer was compared to Example 2 and Example 3 on a Universal 40 mm drum electrical scanner set at 75 ms timing and having 680 nm exposure and erase. As shown in FIG. 2, the addition of bis [4-(methoxymethyl) phenyl] phenylamine (AE139) to the formulation does not impact electrical performance despite the reduction in HTM building block. It is thought that the bis [4-(methoxymethyl) phenyl] phenylamine (AE139) participates in hole transport as a typical free HTM in polymer and this compensates for the loss of HTM building block.

Example 7

Wear Rate Evaluation

The conventional fluorinated SOF (Example 2) and the fluorinated SOF including the AE139 additive (Example 3) were evaluated for wear rate in a Hodaka Fixture assembly along with comparative Example 4 without any overcoat layer. The wear rate of the drum with AE139 was 45 nm/kc which is about 50% improved over comparative Example 4 (standard drum). However, it is significantly higher than the traditional fluorinated SOF overcoat in Example 2 which is ~25 nm/kc. This increase in wear rate is thought to be very manageable due to the target platform being scorotron based which inherently has lower wear rates.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An overcoat layer comprises:

a structured organic film (SOF) comprising a plurality of segments and a plurality of linkers including a first fluorinated segment and a second electroactive segment;

an antioxidant which does not form a network with the SOF; and a hole transport molecule which does not form a network with the SOF, wherein the hole transport molecule comprises (bis [4-methoxymethyl]phenyl)phenylamine).

2. The overcoat layer of claim 1, wherein the hole transport molecule is present in the SOF in an amount of from about 0.1% to about 20%.

3. The overcoat layer of claim 1, wherein the antioxidant comprises bis(4-diethylamino-2-methylphenyl)-4-diethylaminophenylmethane.

4. The overcoat layer of claim 1, wherein the antioxidant is present in the SOF in an amount of from about 0.25% to about 10%.

5. The overcoat layer of claim 1, wherein the first fluorinated segment and the second electroactive segment are present in the SOF of the overcoat layer in an amount of from about 90 to about 99.5 percent by weight of the SOF.

6. The overcoat layer of claim 1, wherein the overcoat layer is from about 2 to about 10 microns thick.

7. The overcoat layer of claim 1, wherein the first fluorinated segment comprises

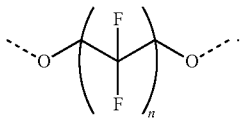

$n = 4$ to 10

8. The overcoat layer of claim 1, wherein the first fluorinated segment is obtained from a fluorinated building block selected from the group consisting of 2,2,3,3,4,4,5,5-octafluoro-1,6-hexanediol, 2,2,3,3,4,4,5,5,6,6,7,7-dodecanfluoro-1,8-octanediol, 2,2,3,3,4,4,5,5,6,6,7,7,8,8,9,9-perfluorodecane-1,10-dial, (2,3,5,6-tetrafluoro-4-hydroxymethyl-phenyl)-methanol, 2,2,3,3-tetrafluoro-1,4-butanediol, 2,2,3,3,4,4-hexafluoro-1,5-pentanedial, and 2,2,3,3,4,4,5,5,6,6,7,7,8,8-tetradecafluoro-1,9-nonanediol.

9. The overcoat layer of claim 1, wherein the first fluorinated segment is present in the SOF of the overcoat layer in an amount from about 30% to about 70% by weight of the SOF.

10. The overcoat layer of claim 1, wherein the second electroactive segment is N4,N4,N4',N4'-tetrakis(4-(methoxymethyl)phenyl)biphenyl-4,4'-diamine.

11. The overcoat layer of claim 1, wherein second electroactive segment is present in the SOF of the outermost layer in an amount from about 30 to about 70 percent by weight of the SOF.

12. The overcoat layer of claim 1, wherein the fluorine content of the imaging member is from about 5 to about 75 percent by weight of the imaging member.

13. An imaging member comprising:

a substrate;

a charge generating layer;

a charge transport layer; and an overcoat layer comprises:

a structured organic film (SOF) comprising a plurality of segments and a plurality of linkers including a first fluorinated segment and a second electroactive segment; and an antioxidant which does not form a network with the SOF; and a hole transport molecule which does not form a network with the SOF, wherein the hole transport molecule comprises (bis [4-methoxymethyl]phenyl) phenylamine).

14. The imaging member of claim 13, wherein the antioxidant comprises bis(4-diethylamino-2-methylphenyl)-4-diethylaminophenylmethane.

15. A xerographic apparatus comprising:

an imaging member comprising a plurality of layers, wherein an overcoat layer of the imaging layer is an imaging surface that comprises a structured organic film (SOF) comprising a plurality of segments and a plurality of linkers including a first fluorinated segment and a second electroactive segment; and an antioxidant is present in the SOF; and a hole transport molecule which does not form a network with the SOF, wherein the hole transport molecule comprises (bis [4-methoxymethyl] phenyl)phenylamine);

a charging unit to impart an electrostatic charge on the imaging member;

an exposure unit to create an electrostatic latent image on the imaging member;

an image material delivery unit to create an image on the imaging member;

a transfer unit to transfer the image from the imaging member; and an optional cleaning unit.

16. A xerographic apparatus of claim 15, wherein the hole transport molecule is present in the SOF in an amount of from about 0.1% to about 20%.

17. A xerographic apparatus of claim 15, wherein the first fluorinated segment comprises

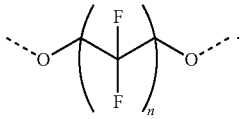

$n$ = 4 to 10

* * * * *